US006332583B1

(12) United States Patent
Bordignon et al.

(10) Patent No.: US 6,332,583 B1
(45) Date of Patent: Dec. 25, 2001

(54) DEVICE TO FORM SPIRALS IN A COILING MACHINE FOR ROLLED STOCK

(75) Inventors: Giuseppe Bordignon, Bicinicco; Andrea De Luca, Remanzacco; Alfredo Poloni, Fogliano di Redipuglia, all of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/432,154

(22) Filed: Nov. 2, 1999

(30) Foreign Application Priority Data

Nov. 4, 1998 (IT) ..... UD98A0189

(51) Int. Cl.[7] ..... B65H 57/00; B65H 54/02; B21F 3/04

(52) U.S. Cl. ..... 242/157.1; 242/447.2; 242/483.3; 72/144

(58) Field of Search ..... 242/362, 483.3, 242/483.1, 483.5, 447.1, 447.2, 157.1, 397.1; 72/144, 148

(56) References Cited

U.S. PATENT DOCUMENTS

| | | | | |
|---|---|---|---|---|
| 1,797,331 | * | 3/1931 | Dale | 72/144 X |
| 3,589,641 | * | 6/1971 | Lawrence | 242/157.1 |
| 3,815,846 | * | 6/1974 | Biewer | 242/157.1 X |
| 3,833,184 | * | 9/1974 | Hara et al. | 242/157.1 X |
| 4,421,284 | * | 12/1983 | Pan | 242/157.1 X |
| 4,592,521 | * | 6/1986 | Hallikas | 242/157.1 |
| 4,664,329 | | 5/1987 | Pali . | |
| 4,756,489 | * | 7/1988 | De Varennes | 242/483.3 |

FOREIGN PATENT DOCUMENTS

| | | | |
|---|---|---|---|
| 0821666 | | 11/1951 | (DE) . |
| 0226547 | | 6/1987 | (EP) . |
| 2 058 703 | * | 4/1981 | (GB) ..... 72/144 X |

OTHER PUBLICATIONS

Patent Abstracts of Japan, vol. 14, No. 196, Apr. 20, 1990 for JP 2037913, published Feb. 07, 1990.

* cited by examiner

*Primary Examiner*—Michael R. Mansen
(74) *Attorney, Agent, or Firm*—Stevens, Davis, Miller & Mosher, LLP

(57) ABSTRACT

Device to form spirals in a coiling machine for trolled stock located downstream of a rolling train provided with drawing rollers, wherein the coiling machine includes a reel able to rotate around an axis of rotation, including a guide element suitable to guide the rolled stock in a segment between the drawing rollers and the coiling machine, first translating means being suitable to cooperate with the guide element to displace at least one end of the latter in a direction substantially parallel to the axis of rotation of the reel.

16 Claims, 3 Drawing Sheets

DEVICE TO FORM SPIRALS IN A COILING MACHINE FOR ROLLED STOCK

FIELD OF THE INVENTION

This invention concerns a device to form spirals in a coiling machine for rolled stock, such as bars, plate, or rods (smooth or ribbed) of hot-rolled metal material, with a cross-section either round, square, rectangular, hexagonal or otherwise.

To be more exact, the invention concerns a device to guide the formation of the spirals of a coil of rolled stock, wherein each coil consists of a plurality of super-imposed and coaxial layers of helical spirals.

BACKGROUND OF THE INVENTION

The state of the art includes a device to form spirals wherein a curved element is arranged inside a containing cylinder, in which the spirals are formed and accumulate, and is kept substantially parallel to the inner surface of the containing cylinder.

In this device, while the containing cylinder is made to rotate, the curved element is made to gradually advance, parallel to the axis of rotation of the cylinder, and is removed from inside the coil when the latter has been completed.

Although this device facilitates the formation of the spirals of the coil, it does not ensure that a compact coil is formed, since the reciprocal movement of the spiralforming tool and the containing cylinder is quite uncontrolled and since the stock which is being coiled is not subjected to a controlled tension.

The U.S. Pat. No. 4,664,329 discloses a coiler to wind a wire around a central mandrel which is rotated by means of a belt contacting the mandrel outer surface and disposed around a plurality of pulleys, one of which is connected to a motor. In this device the wire to be wound is horizontally moved by a first traverse assembly mounted slidable on fixed bars parallel to the rotational axis of the mandrel and is vertically moved by a plate connected to an actuator and independent from the traverse assembly. On such a plate is also mounted one of the pulleys which control the movement of the belt. This device has the disadvantage that the wire to be wound arrives in the proximity of the mandrel not always perpendicular to the rotational axis of the mandrel, but with an inclination which is more or less accentuated in accordance with the position of the traverse assembly with respect to the mandrel; consequently the different coils on a same layer are not uniformly distributed.

The present applicant has designed, tested and embodied this invention to overcome the shortcomings of the state of the art and to obtain further advantages.

SUMMARY OF THE INVENTION

The device to form spirals in a coiling machine for rolled stock according to the invention is set forth and characterised in the main claim, while the dependent claims describe other characteristics of the invention.

The main purpose of the invention is to provide a device to form the spirals in a coiling machine for rolled stock, wherein the formation of the spirals is constantly controlled and wherein each spiral is at a pre-set distance from the adjacent spiral, so that the packing of the coil can also be pre-set.

In accordance with this purpose, the device to form the spirals in a coiling machine for rolled stock according to the invention comprises a guide element suitable to guide the rolled stock in a segment between the drawing rollers in a rolling train located upstream of the coiling machine, which comprises a reel rotating around its own axis of rotation. To be more exact, the device according to the invention is provided with first translating means which are suitable to cooperate with the guide element to displace at least one end of the latter in a direction substantially parallel to the axis of rotation of the reel of the coiling machine.

A second purpose of the invention is to provide a device to form the spirals in a coiling machine for rolled stock which will hold the rolled stock under tension and will control the resistant traction of each rolled product while it is being coiled.

A third purpose of the invention is to provide a device to form the spirals in a coiling machine for rolled stock which will allow to process rolled stock of metallic material of any type, such as bars, plate, or rods (smooth or ribbed), with a cross section of any shape: round, square, rectangular, hexagonal or otherwise; and with diameters of between 8 and 52 mm or, in the case of bars or plate, with a section of between 60 $mm^2$ (for example, 20 mm by 3 mm) and 1400 $mm^2$ (for example, 70 mm by 20 mm), without there being any particular wear on the guide organs suitable to distribute the spirals on the coiling machine.

A further purpose of the invention is to provide a device to form the spirals in a coiling machine for rolled stock travelling at very high speeds, more than 40 metres per second and wherein the distribution of the spirals of the coil will be guided in a transverse direction as well, that is to say, ring after ring or layer after layer, so as to obtain a compact coil.

BRIEF DESCRIPTION OF THE DRAWINGS

These and other characteristics of the invention will be clear from the following description of a preferred form of embodiment, given as a non-restrictive example with the help of the attached drawings wherein.

DETAILED DESCRIPTION OF PREFERRED EMBODIMENT

Figure 1:
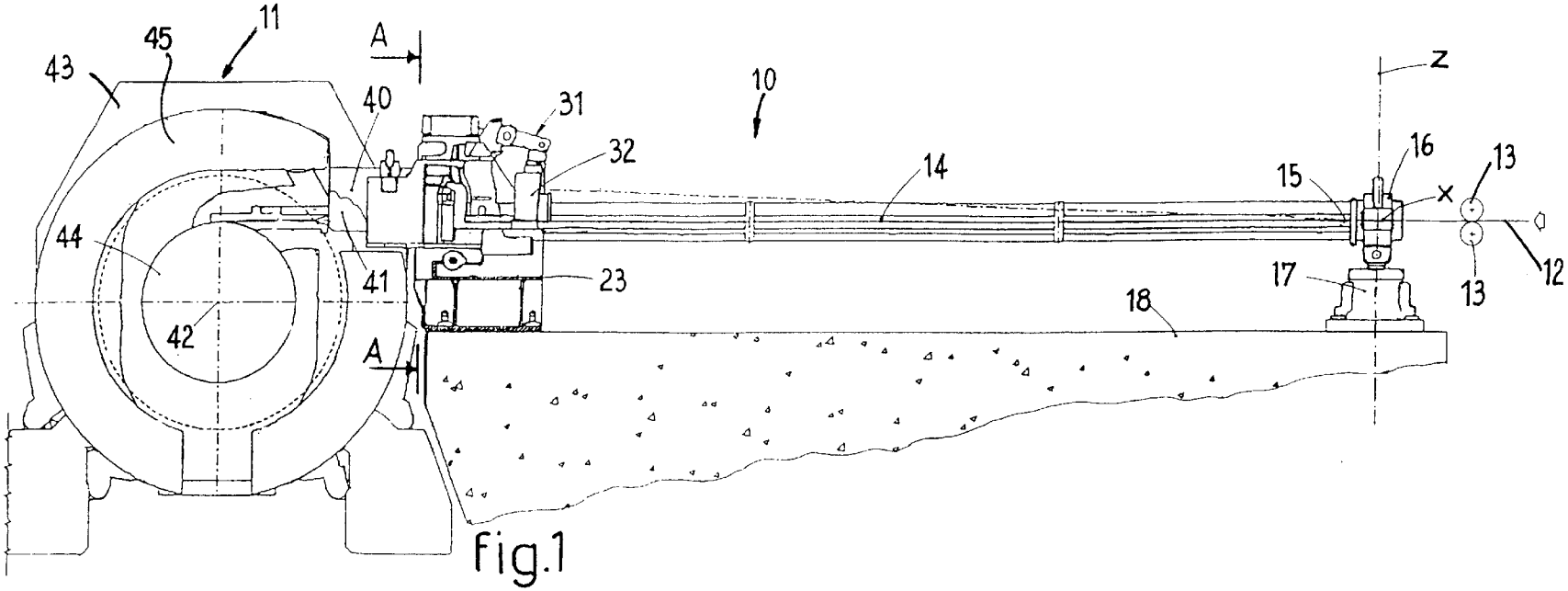
FIG. 1 is a side view of a device to form the spirals in a coiling machine for rolled stock according to the invention.

With reference to FIG. 1, a device 10 to form spirals in a coiling machine 11 for rolled stock 12 is suitable to be arranged downstream of a rolling train of a known type, equipped with motorised drawing rollers 13 suitable to draw the rolled stock 12 at high speed, up to more than 40 metres per second.

The device 10 is suitable to form the spirals of rolled stock 12 of metallic material, such as steels with low, medium or high carbon content, stainless steel, alloys or other types, with a cross section of any type and with a size of between 60 and 1400 $mm^2$.

The device 10 comprises a straight, tubular guide 14, about 5.5 metres long; an end 15 pivots on the horizontal pin of a turret 16 which in turn pivots on the vertical pin of a support 17 mounted on a base 18.

Figure 4:
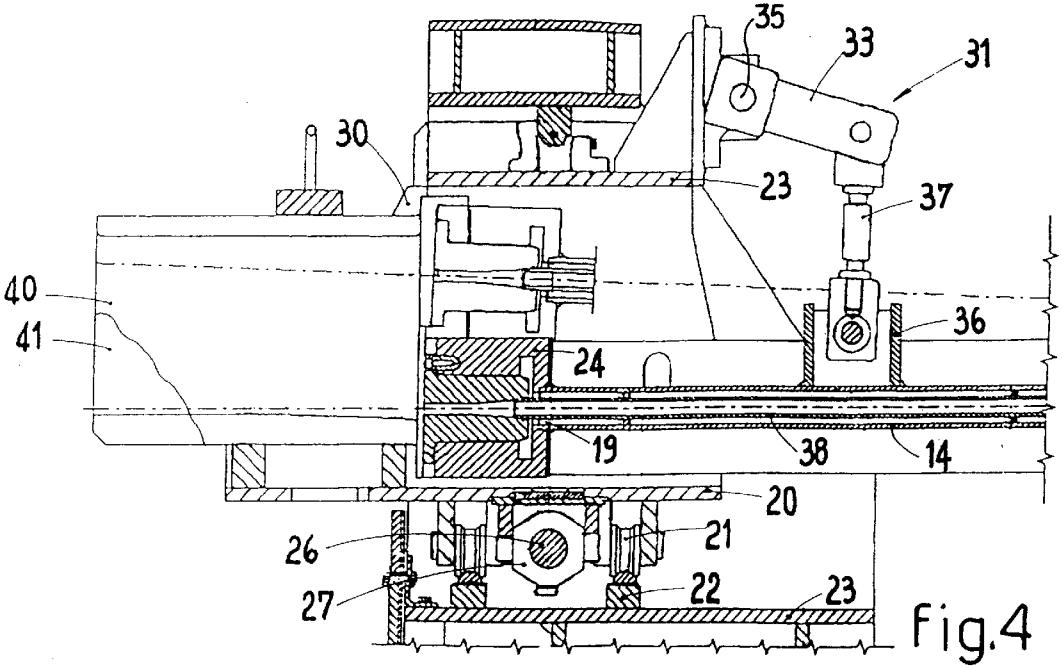
FIG. 4 is an enlarged detail of FIG. 1.

The other end 19 (FIG. 4) of the tubular guide 14 is attached to a head 24 mounted on a distribution carriage 20, which is provided with lower wheels 21 guided on horizontal rails 22 mounted on a metallic structure 23 attached to the base 18.

Inside the tubular guide 14 there is a tube 38 made of wear-resistant material.

The distribution carriage 20 is movable horizontally, in both directions, from right to left (FIG. 3) and from left to right, under the command of a low inertia electric motor 25, which is suitable to command the rotation of a screw 26 with which a corresponding nut screw 27, attached to the carriage 20, is engaged. Between the motor 25 and the screw 26 there is an inverter 28.

Figure 2:
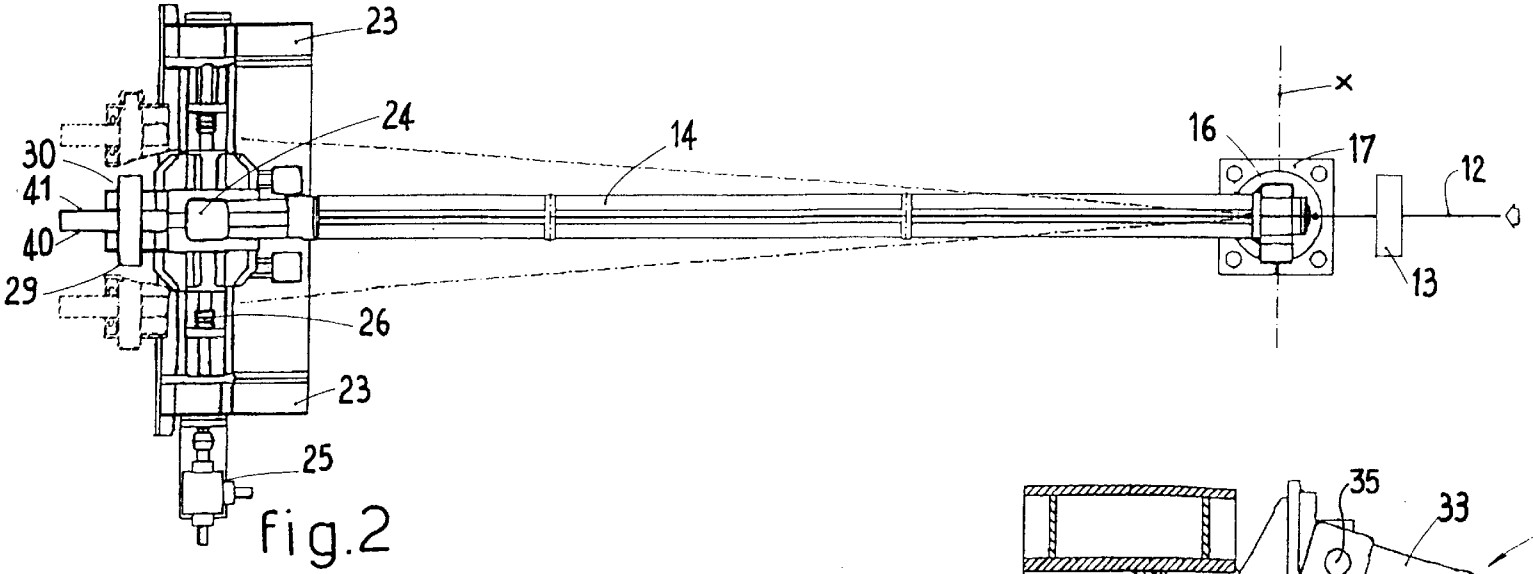
FIG. 2 is a part view from above of the device shown in FIG. 1.
Figure 5:
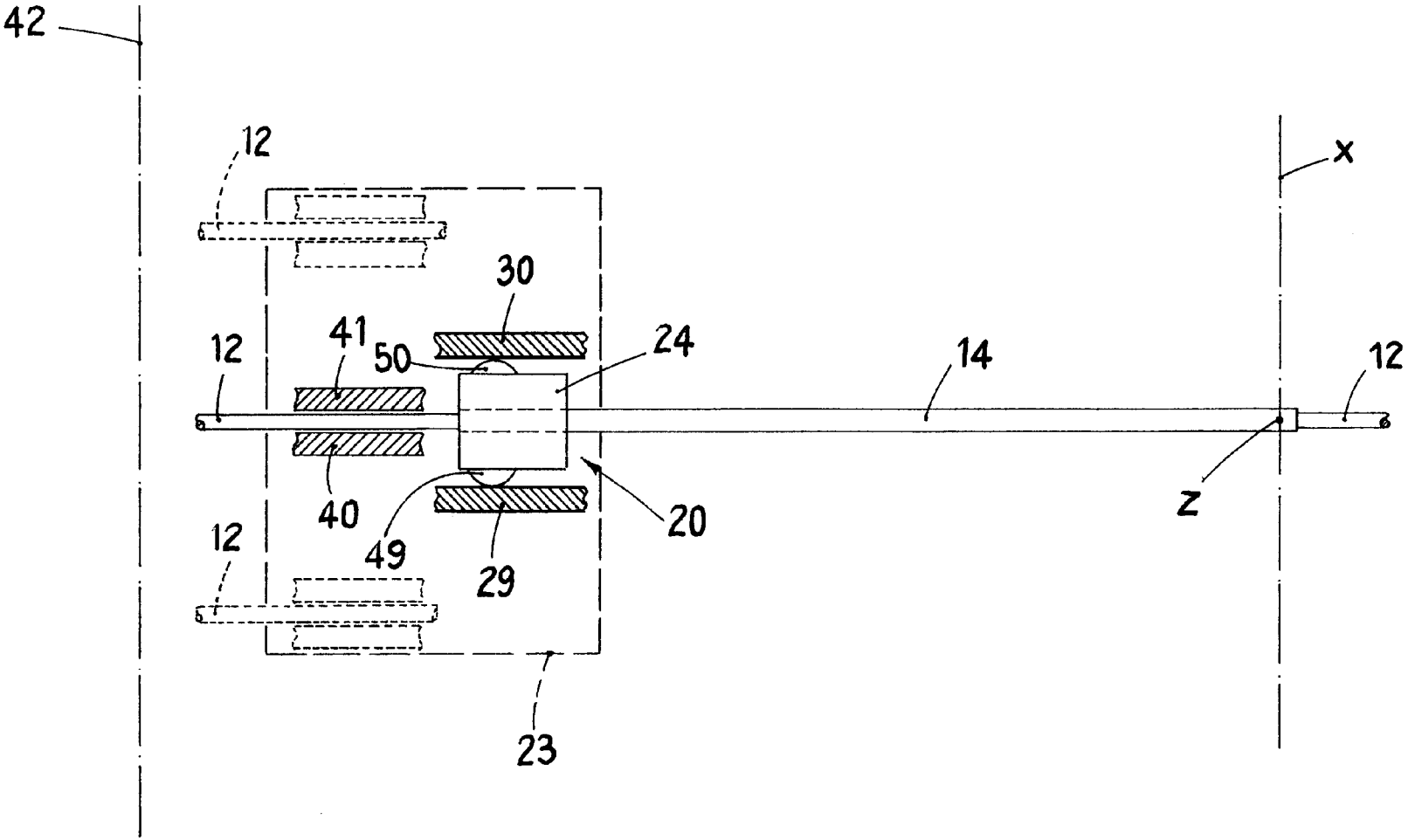
FIG. 5 is a part and schematic view from above of the device shown in FIG. 1.

The head 24 on which the end 19 of the guide 14 is attached, is arranged between two vertical guide walls 29 and 30 of the carriage 20 (FIGS. 2 and 5) and is provided of two sliding blocks 49 and 50. In this manner the head 24 can slide vertically with respect to the carriage 20 and the relevant movement is realised by a balancing mechanism 31 of a pneumatic type.

More in particular, thanks to the above described coupling, the head 24 can describe both an arc of circumference about an horizontal axis x passing through the turret 16 and intersecting the plane where the rolled stock 12 lies, both an arc of circumference about a vertical axis z (FIG. 1) intersecting the horizontal axis x and the rolled stock 12.

The mechanism 31 comprises an actuator 32 (FIG. 1) arranged substantially vertical and with the lower end attached on the metallic structure 23 and the upper end connected to a balancer 33 (FIG. 4) which pivots on a pin 35 of the structure 23.

The balancer 33 is connected to an upper appendix 36 of the tubular guide 14 by means of an articulated rod 37.

Two vertical guide plates 40 and 41, parallel to each other and orthogonal to the rails 21, are attached on the carriage 20 and extend towards the coiling machine 11. The distance between the guide plates 40 and 41 is substantially equal to the transversal dimension of the rolled stock 12 to be wound on the reel 44. The guide plates 40 and 41 are able to guide the rolled stock 12 immediately before the latter is wound on the reel 44.

The coiling machine 11 is of the type with a horizontal axis of rotation 42 and comprises a frame 43 on which a cylindrical mandrel or reel 44 is mounted, selectively rotatable on the axis 42 by means of a motor organ which is not shown in the drawings. Circular guide means 45 are included in the coiling machine 11 to facilitate the formation of the first spirals of the coil of rolled stock 12 which is to be formed coaxial to the reel 44.

The device 10 described heretofore functions as follows:

In its non-active position the device 10 has the guide 14 arranged substantially on a horizontal plane, tangent to the cylindrical surface of the reel 44, and with the carriage 20 displaced towards the inner part of the reel 44, for example towards the right side (FIG. 3) of the metallic structure 23, with the vertical guides 40 and 41 arranged in correspondence with the guide means 45 (FIG. 1) of the coiling machine 11 perpendicular to the axis of rotation 42.

In order to form a coil of rolled stock 12 on the coiling machine 11, the leading end of the rolled stock 12 arriving from the rolling train is inserted into the end 15 of the tubular guide 14 and is conveyed through this towards the coiling machine 11, thrust by the drawing rollers 13. The latter also guarantee that a pre-set tension is maintained for the rolled stock 12 along the whole length of the conveyor line, and that it is wound under traction onto the mandrel 44 of the coiling machine 11.

The drawing rollers 13 cooperate with other drawing rollers located upstream, which are not shown in the drawings. The drawing rollers 13 are also able to form a vertical loop needed to accumulate rolled stock 12 to be supplied quickly to the coiling machine 11 as the diameters of the coil are increased during the same coiling cycle. The drawing rollers 13 brake the trailing end of the rolled stock 12 to keep it at the desired tension during the step when the mandrel 44 decelerates and stops at the end of coiling.

The reel 44 of the coiling machine 11 is made to rotate and the rolled stock 12 is guided towards the coiling machine 11 by the tubular guide 14 of the device 10.

Figure 3:
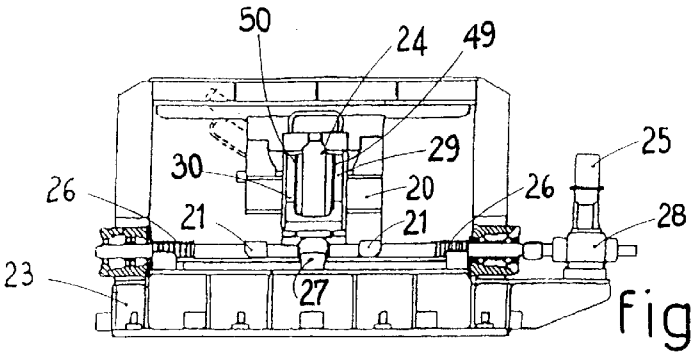
FIG. 3 is a view along the line III—III of FIG. 1.

The first spirals are formed with the help of the means 45 included on the coiling machine 11, after which the motor 25 gradually displaces the carriage 20, by means of the coupling of the screw 26 and the nut screw 27, towards the outermost end of the reel 44, for example towards the left in FIG. 3.

During the horizontal movement of carriage 20, the vertical guides 40 and 41 maintain the section of rolled stock 12 which comes out from the head 24 constantly perpendicular to the axis of rotation 42 of the reel 44, so that the spirals are formed with high precision and regularity in any zone, both median and peripheral of the reel 44.

In this way, by adjusting the speed of rotation of the motor 25 according to the peripheral coiling speed of the reel 44, to the transverse dimensions of the rolled stock 12 being coiled, and to the primitive diameter of the ring of spirals being formed, it is possible to displace the carriage 20 and the end 19 of the guide 14 by a defined quantity with every revolution of the reel 44, thus precisely defining and controlling the packing of the coil which is forming.

When the carriage 20 has arrived at the end of its travel and the first layer or ring of spirals of the coil of rolled stock 12 has been completed, the direction of rotation of the screw 26 is inverted, by means of the inverter 28, and consequently the direction of movement of the carriage 20, which returns towards its initial starting position.

When the direction of movement of the carriage 20 is inverted, then the diameter of the rolled stock 12 being coiled is also increased, and the rolled stock 12 is taken above the ring of spirals which has just been formed. At the same time, the mechanism 31 begins to function and, by means of the actuator 32, lifts the head 24 and the end 19 of the guide 14.

An identical movement takes place every time the movement of the carriage 20 is inverted, either to the right or to the left. The guide 14 will thus lean more and more vertically upwards, until the coiling of the rolled stock 12 onto the coiling machine 11 has been finished.

The guide plates 40 and 41 keep the rolled stock 12 constantly transverse to the axis of rotation 42 of the reel 44, notwithstanding the inclination either horizontal or vertical of the guide 14; they thus guarantee a perfect and constant formation and distribution of the spirals in the coil.

In this way the spirals are distributed in a rational and controlled manner, both on every individual ring and also on the different coaxial rings of the coil.

It is obvious that it is possible to make modifications and add parts to the device 10 to form spirals in a coiling machine 11 for rolled stock 12 as described heretofore, but these will remain within the spirit and scope of the invention.

For example, in order to invert the direction of translation of the carriage 20 at the end of every travel, instead of inverting the direction of rotation of the screw 26, by means of the inverter 28, it is possible to include a double-threaded screw, a right-hand thread and a left-hand thread, with which it is possible to couple a corresponding nut screw in alternation.

What is claimed is:

1. A device to form spirals in a coiling machine for rolled stock located downstream of a rolling train provided with drawing rollers, wherein said coiling machine comprises:

(i) a reel able to rotate around an axis of rotation, wherein said device comprises a guide element for guiding said rolled stock in a segment between said drawing rollers and said coiling machine;

(ii) first translating means connected to said guide element to displace at least a first end of said guide element in a direction substantially parallel to said axis of rotation of said reel;

(iii) second translating means connected to said guide element to positively displace at least said first end of said guide element on a plane substantially perpendicular to said axis of rotation of said reel; and (iv) wherein said first translating means are provided with guide means able to guide at least a section of said rolled stock for maintaining the latter constantly perpendicular to said axis of rotation of said reel immediately before its winding on said reel, irrespective to the longitudinal position of said first end of said guide element, with respect to said reel during the displacement of said first end along said direction substantially parallel to said axis of rotation of said reel.

2. The device as in claim 1, wherein said guide means comprise first and second plates, arranged parallel to each other and perpendicular to said axis of rotation of said reel, the distance between said plates being substantially equal to the transversal dimension of said rolled stock to be wound on said reel.

3. The device as in claim 1, wherein said guide element comprises a tubular guide substantially rectilinear and having said first end arranged near said reel and a second end arranged far from said reel, said first translating means cooperating with said first end to displace said first end parallel to said axis of rotation.

4. The device as in claim 3, wherein said second translating means cooperate with said first end to allow the latter to move on a plane perpendicular to said axis of rotation.

5. The device as in claim 4, wherein said second end of the guide pivots on a horizontal pin of a turret, which in turn pivots on a vertical pin of a support mounted on a base.

6. The device as in claim 3, wherein said second end of the guide is substantially stationary.

7. The device as in claim 3, wherein said guide element is connected to said second translating means, and said second translating means includes a balancing mechanism able to control the displacement of said head along a plane perpendicular to that on which said carriage slides.

8. The device as in claim 3, wherein said tubular guide has a cylindrical element inside, made of wear-resistant material.

9. The device as in claim 1, wherein said first translating means comprise a carriage which slides on a plane parallel to said axis of rotation and that said second translating means comprise a head mounted to slide on said carriage perpendicularly to said axis of rotation.

10. The device as in claim 9, wherein said carriage is connected to drive means able to displace it alternately backwards and forwards, along a straight path substantially parallel to said axis of rotation, said drive means comprising a screw/nut screw connection.

11. The device as in claim 9, wherein said head is slidably mounted between two vertical guide walls of said carriage and is provided of two sliding blocks whereby said head can slide transversally with respect to said carriage.

12. The device as in claim 11, wherein said head is able to describe both an arc of circumference about a horizontal axis passing through said turret and intersecting a plane defined by where said rolled stock lies, both an arc of circumference about a vertical axis intersecting said horizontal axis and said rolled stock.

13. The device as in claim 9, wherein said head is able to describe both an arc of circumference about a horizontal axis passing through said turret and intersecting a plane defined by where said rolled stock lies, both an arc of circumference about a vertical axis intersecting said horizontal axis and said rolled stock.

14. The device as in claim 9, wherein said guide element is connected to said second translating means, and said second translating means includes a balancing mechanism able to control the displacement of said head along a plane perpendicular to that on which said carriage slides.

15. The device as in claim 1, wherein said guide element is adapted to lie in a plane substantially tangent to the outer cylindrical surface of said reel when said guide element is in its inactive position.

16. The device as in claim 1, wherein said reel is substantially horizontal and rotated about an axis, and wherein said guide element is adapted to lie in a plane substantially tangent to the outer cylindrical surface of said reel when said guide element is in its inactive position.

* * * * *